US005743109A

United States Patent [19]

Schulak

[11] Patent Number: 5,743,109

[45] Date of Patent: Apr. 28, 1998

[54] ENERGY EFFICIENT DOMESTIC REFRIGERATION SYSTEM

[76] Inventor: Edward R. Schulak, 567 Aspen, Birmingham, Mich. 48009

[21] Appl. No.: 702,102

[22] Filed: Aug. 23, 1996

[51] Int. Cl.[6] ..... F25D 17/06

[52] U.S. Cl. ..... 62/428; 62/440; 62/404; 62/238.6

[58] Field of Search ..... 62/89, 428, 404, 62/405, 406, 426, 440, 238.1, 238.6, 238.7, 255

[56] References Cited

U.S. PATENT DOCUMENTS

| | | |
|---|---|---|
| 1,769,119 | 7/1930 | Davenport . |
| 2,234,753 | 3/1941 | Frazer . |
| 2,249,772 | 7/1941 | Maniscalco . |
| 2,362,729 | 11/1944 | Smith . |
| 2,517,686 | 8/1950 | Larkin . |
| 2,579,056 | 12/1951 | Thompson . |
| 2,655,795 | 10/1953 | Dyer . |
| 3,017,162 | 1/1962 | Haines et al. . |
| 3,123,986 | 3/1964 | Lukas et al. . |
| 3,248,895 | 5/1966 | Mauer . |
| 3,370,438 | 2/1968 | Hopkinson . |
| 3,478,533 | 11/1969 | Kocher et al. . |
| 3,500,655 | 3/1970 | Lyons . |
| 3,785,168 | 1/1974 | Domingorene . |
| 3,905,202 | 9/1975 | Taft et al. . |
| 4,008,579 | 2/1977 | Horvay . |
| 4,068,494 | 1/1978 | Kramer . |
| 4,136,528 | 1/1979 | Vogel et al. . |
| 4,210,000 | 7/1980 | Lee . |
| 4,220,011 | 9/1980 | Berman et al. . |
| 4,245,481 | 1/1981 | McDermott . |
| 4,365,983 | 12/1982 | Abraham et al. . |
| 4,437,317 | 3/1984 | Ibrahim . |
| 4,474,022 | 10/1984 | Puskar . |
| 4,735,059 | 4/1988 | O'Neal . |
| 4,815,298 | 3/1989 | Van Steenburgh, Jr. . |
| 5,050,398 | 9/1991 | Lane et al. . |
| 5,070,705 | 12/1991 | Goodson et al. . |
| 5,081,850 | 1/1992 | Wakatsuki et al. . |
| 5,144,816 | 9/1992 | Chase . |
| 5,228,313 | 7/1993 | Okamoto et al. ..... 62/440 |
| 5,291,749 | 3/1994 | Schulak . |
| 5,347,827 | 9/1994 | Rucick et al. ..... 62/440 |
| 5,402,651 | 4/1995 | Schulak . |
| 5,520,007 | 5/1996 | Schulak . |

FOREIGN PATENT DOCUMENTS

| | | |
|---|---|---|
| 2189693 | 1/1974 | France . |
| 17 79 653 B2 | 1/1978 | Germany . |
| 41 14 915 A1 | 11/1992 | Germany . |
| 43 00 750 A1 | 5/1993 | Germany . |
| 1508722 | 4/1978 | United Kingdom . |
| WO 94/15158 | 7/1994 | WIPO . |
| WO 95/16887 | 6/1995 | WIPO . |

*Primary Examiner*—John M. Sollecito
*Attorney, Agent, or Firm*—Harness, Dickey & Pierce, P.L.C.

[57] ABSTRACT

An energy transfer system for a household refrigeration appliance. The energy transfer system includes a first venting system within the refrigeration appliance for cooling a cooling storage compartment and a second venting system within the refrigeration appliance for cooling at least one component of a refrigeration system which cools the cooling storage compartment, and a first and second set of conduits for enabling the transfer of outside air into, through and out of the first and second venting system. In one form of the present invention, the system may also include a thermostatically actuated valve for enabling outside air into, through and out of the compartment in response to a predetermined temperature.

6 Claims, 4 Drawing Sheets

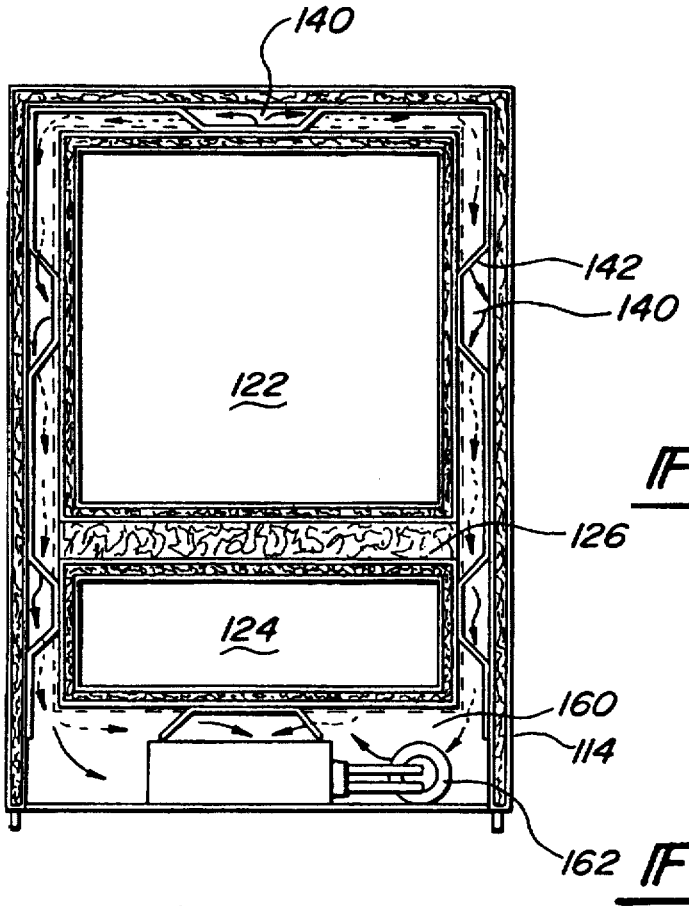
Fig-7
Fig-8
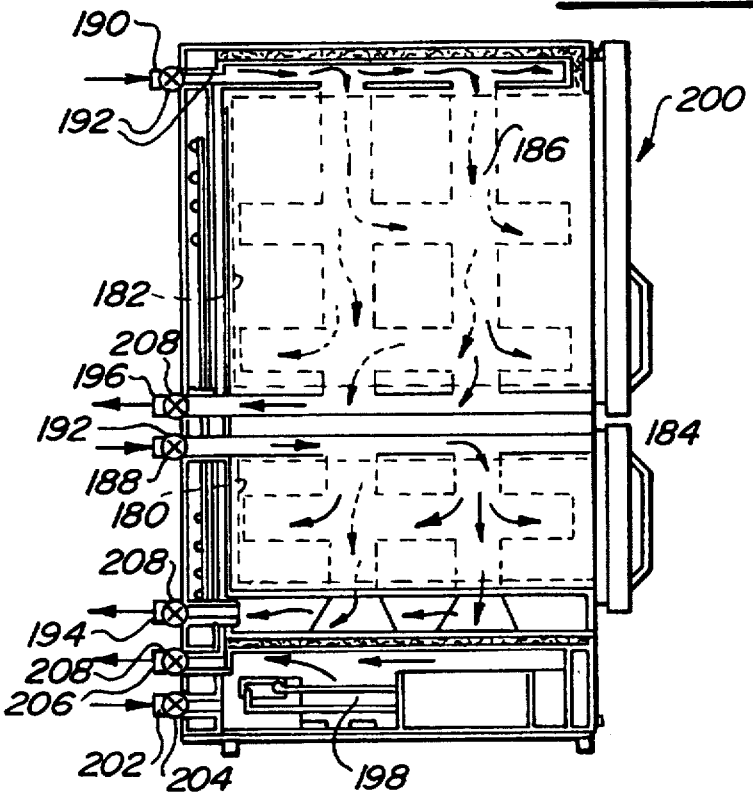

ENERGY EFFICIENT DOMESTIC REFRIGERATION SYSTEM

BACKGROUND OF THE INVENTION

The present invention generally relates to domestic refrigerators and freezers. More particularly, the present invention relates to a system and method for utilizing cool outdoor ambient temperature levels to reduce the energy required to operate a domestic refrigerator or freezer system.

Virtually every home and apartment in this country has at least one refrigerator for storing perishable food products. Additionally, many households also have a freezer for storing food products over extended periods of time. As a consequence of such widespread usage, these domestic appliances consume a substantial part of the electrical energy which is generated by the nation's utility companies. In this regard, it should be noted that despite recent strides, refrigerators are still only half as efficient as the theoretical limit, the Reverse Carnot Cycle. Consequently, a substantial opportunity still exists to increase the energy efficiency of domestic refrigeration appliances. Since even the newest refrigerators consume approximately 700 kwh of electricity per year, it should be understood that a substantial need still exists to increase the energy efficiency of domestic refrigeration appliances.

Accordingly, it is a principal objective of the present invention to provide a system and method which reduces the energy required to operate domestic refrigerator and freezer systems.

It is another objective of the present invention to provide an energy efficient domestic refrigeration system which minimizes the heat generated inside a home when the desired indoor temperature exceeds the outdoor ambient temperature.

It is a further objective of the present invention to provide a domestic refrigeration system which may be applied to retrofit existing domestic refrigeration units or applied at the factory to new domestic refrigeration units.

SUMMARY OF THE INVENTION

To achieve the foregoing objectives, the present invention provides an energy transfer system for a household refrigeration appliance. The energy transfer system includes a compartment for enclosing the condenser and compressor which are associated with the refrigerator, and a set of conduits for enabling the transfer of outside air into, through, and out of the compartment. The system also includes a movable barrier for selectively controlling the transfer of air through the compartment. In one form of the present invention, the system also includes a thermostatically actuated fan for forcing outside air into, through, and out of the compartment in response to a predetermined temperature.

The set of conduits preferably includes a first conduit for enabling the transfer of outside air to the compartment, and a second conduit for enabling the transfer of air from the compartment to the outside environment. Each of these conduits are disposed such that they extend through an external wall of said household. To facilitate the convection flow of air, the outlet of one conduit is connected to the compartment at a location which is lower than an inlet connection of the other conduit.

Additional features and advantages of the present invention will become more fully apparent from a reading of the detailed description of the preferred embodiment and the accompanying drawings in which:

BRIEF DESCRIPTION OF THE DRAWINGS

FIG. 7 is a cross-sectional view of FIG. 5 along line 7—7 thereof.

FIG. 8 is a cross-sectional view of a refrigeration appliance in accordance with the present invention.

DETAILED DESCRIPTION OF THE PREFERRED EMBODIMENTS

Figure 1:
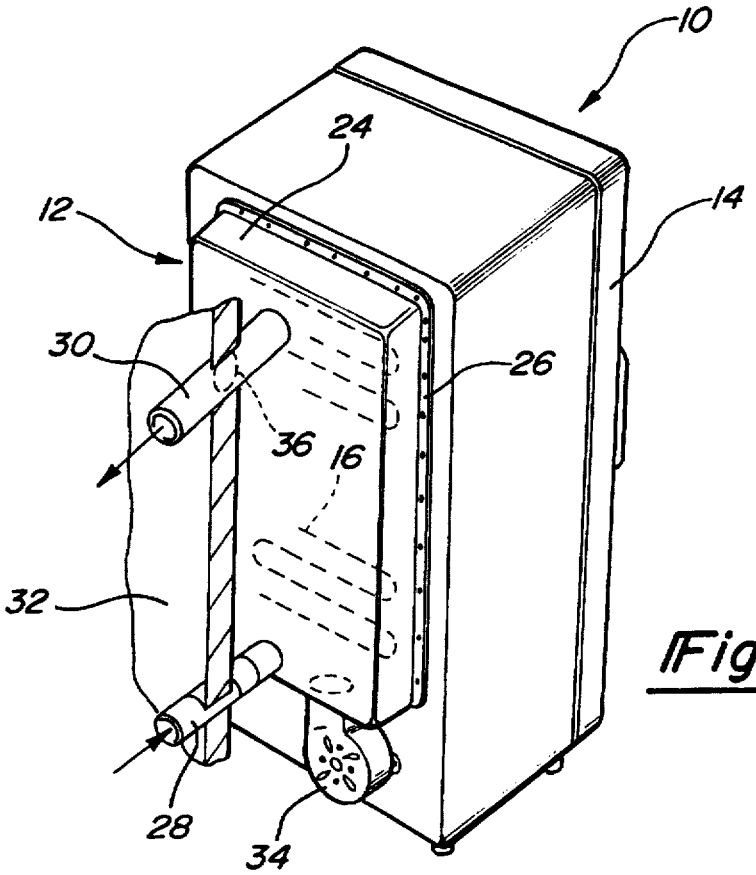
FIG. 1 is a perspective view of a household refrigeration appliance in accordance with the present invention.

Referring to FIG. 1, a perspective view of a household refrigeration appliance 10 in accordance with the present invention is shown. More specifically, the household refrigeration appliance depicted in FIG. 1 is a domestic refrigerator which has been retrofitted with the energy transfer system 12 in accordance with the present invention. However, it should be understood that the principles of the present inventions are equally applicable to a domestic refrigerator which has been constructed at the originating factory to include a built-in energy transfer system. Additionally, it should be appreciated that the present invention is directed at household refrigeration appliances, such as self-contained refrigerators and freezers, that are specifically adapted for use in a home environment. In this regard, it should be understood that a completely different set of constraints and design criteria may be employed with commercial refrigeration equipment, which have a compressor and refrigerator cabinet in separate locations.

Figure 3:
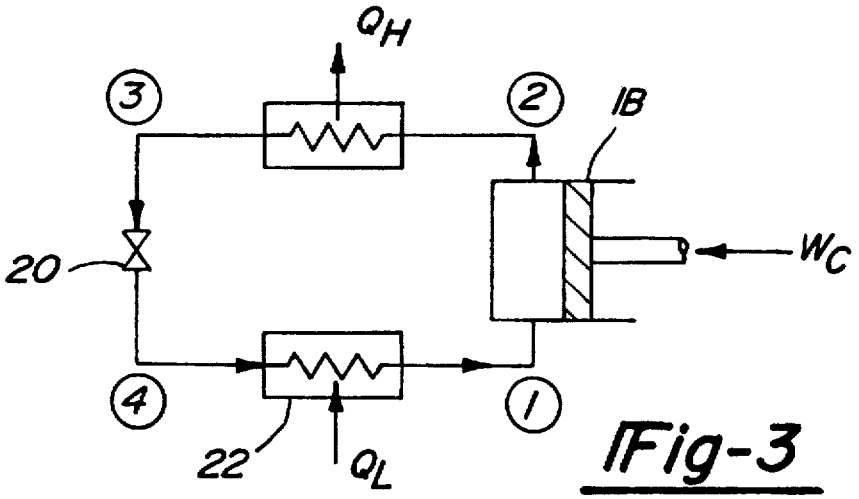
FIG. 3 is a schematic representation of a refrigeration system.

As shown in FIG. 1, the refrigerator 10 generally includes at least one door 14 across its front and a serpentine tube condenser 16 mounted across its back. As well known in the field, the condenser 16 is connected to the discharge end of a pump to condense a refrigerant fluid, such as freon, from a gaseous phase to a liquid phase. This process creates heat which must be removed in order for the refrigeration cycle to work. In this regard, FIG. 3 shows a schematic diagram of a conventional refrigeration cycle, with the pump indicated by reference numeral 18. An expansion device 20 is used to permit the compressed refrigerant to expand in an evaporator coil 22, which is disposed within the interior of the refrigerator 10. This process of expansion operates to remove heat from the interior of the refrigerator 10.

With this household refrigerator arrangement, the heat produced at the condenser 16 is simply released into the area of the home which surrounds the refrigerator. However, in accordance with the present invention, a compartment 24 is used to enclose the condenser 16. As shown in FIG. 1, the compartment 24 may be comprised of a five-sided molded fiberglass shell which is mounted to the exterior side of the refrigerator 19 where the condenser 16 is located. In this regard, the compartment 24 includes a flange 26 which extends around its periphery in order to enable the compartment to be secured to the refrigerator 10 over the condenser 16, such as with a plurality of spaced screws. However, it should be understood that the compartment may be comprised of other suitable materials and may take other suitable shapes in the appropriate application. For example, with a factory built-in energy transfer system, the compartment 24 may be formed integrally with a side of the refrigerator 10, such that the consumer need not discern that the compartment is included as part of the refrigerator body. Additionally, the compartment 24 may be constructed such that it includes an insulative layer in order to more fully control the transfer of heat from the condenser 16.

Figure 2:
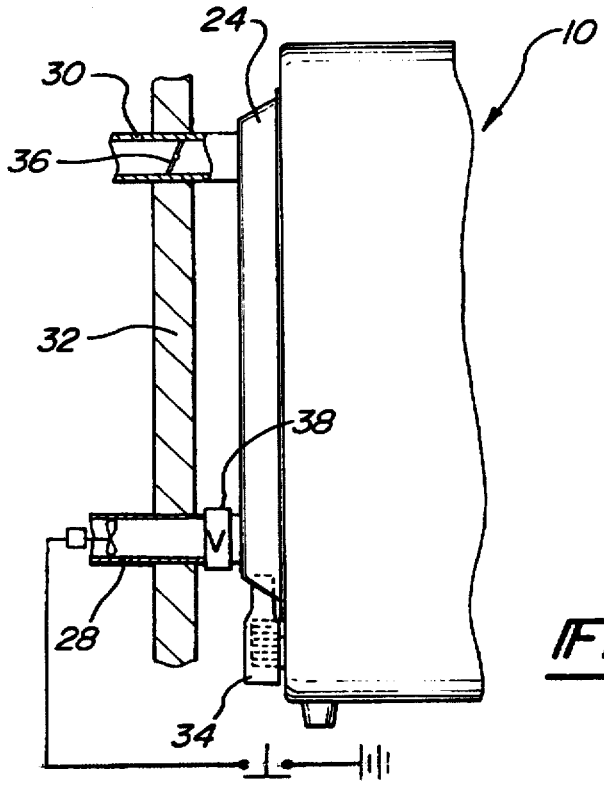
FIG. 2 is a side elevation view of the refrigerator shown in FIG. 1.

The energy transfer system 12 also includes one or more passageways for enabling the transfer of heat out of the compartment 24 and for selectively utilizing outside air in this process. Thus, for example, as shown in FIGS. 1 and 2, the energy transfer system 12 includes a first conduit 28 which enables cool air from outside of the home to enter the compartment 24, and a second conduit 30 which enables air from inside the compartment to be released outside of the home. In this regard, both of these figures show an exterior wall 32 of the household wall, and the conduits 28 and 30 are constructed such that they are able to extend through this exterior wall. The conduits 28 and 30 may be made of any suitable material which is appropriate for this purpose (e.g., sheet metal or flexible insulated duct), and the conduits may be connected to the compartment in a variety of ways.

It should also be noted that the first conduit 28 is connected to the compartment 24 at a location which is lower than that where the second conduit 30 is connected to the compartment. This arrangement is used to facilitate outside air passing through the first conduit 28 into the compartment, through the compartment and out of the second conduit 30 by heat convection. While the conduits 28–30 are shown to be relatively straight pipes or tubes, it should be understood that other suitable shapes may be employed, depending upon such considerations as the available space and the distance between the refrigerator 10 and the exterior wall 32.

FIGS. 1 and 2 also show the provision of a fan 34 or, 35, respectively, which may be used to force the flow of outside air into, through, and out of the compartment 24. While the fan 34 is shown to be connected to the compartment 24 in a way which is separate than the connection of the conduits 28–30 to the compartment, it is preferred that the fan be connected in-line with the first conduit 28, such as fan 35, either within the conduit or adjacent to its outlet into the compartment. Additionally, it is preferred that the fan 34 or 35 be a thermostatically actuated fan, so that its use may be carefully controlled to achieve the most energy efficient benefit.

Additionally, as shown in FIGS. 1 and 2, the energy transfer system 12 also includes a movable barrier or wall in one or both of the conduits 28–30 to control the flow of air through the compartment 24. In one form of the present invention, this movable barrier is comprised of a butterfly valve 36 which may be used to prevent or enable the flow of outside air into the compartment via a butterfly valve disposed in one or both of the conduits 28–30. For example, in the case of butterfly valve 36 disposed in the second conduit 30, the flow of outside air through the first conduit 28 could provide sufficient force to open the butterfly valve, and thereby permit the escape of air from the compartment 24 through the second conduit.

From the above, it should be understood that the energy transfer system 12 allows energy in the form of hot condenser air, to transfer to the cool outdoors, rather than to the warmer indoor ambient. In other words, the present invention provides for a more efficient energy transfer from the refrigeration components to the outside environment, instead of having to transfer these components to the outside. By rejecting heat to a lower temperature reservoir, the condenser will operate at a reduced temperature, and the work of compression will decrease accordingly. Consequently, the overall energy efficiency of the refrigerator will increase.

Figure 4:
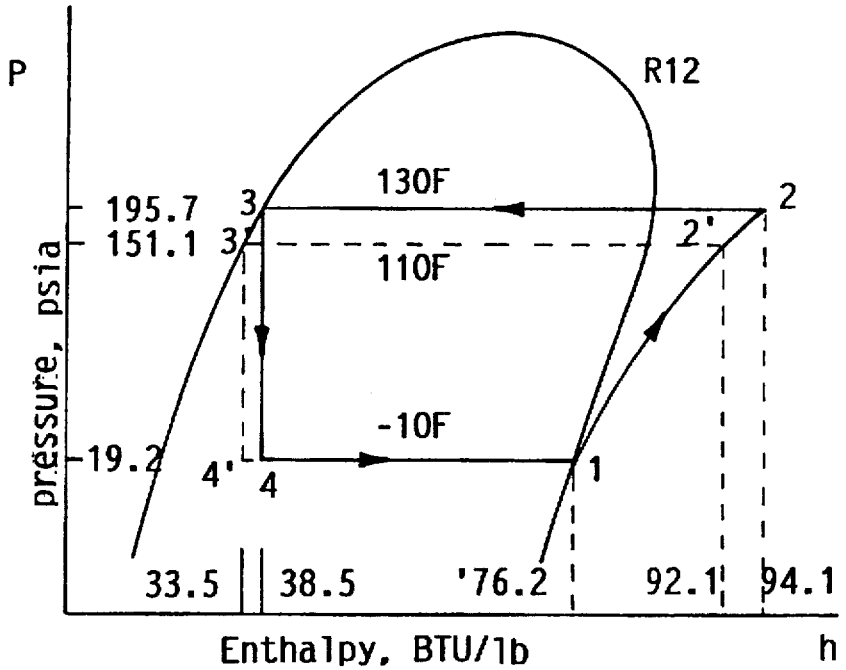
FIG. 4 is a graph of the vapor-compression refrigeration cycle for the refrigeration system of FIG. 3.

FIG. 3 is a schematic diagram of the refrigeration system, while FIG. 4 shows the "Basic" or "Standard" refrigeration cycle on the pressure-enthalpy (p-h) plot of Refrigerant 12. The process 1–2 represents the work of compression, 2–3 condensation, 3–4 expansion, and 4–1 evaporation, i.e. the refrigeration effect. If this Basic refrigerator operates in 90° F. indoor ambient temperature, between 195.7 psia condenser pressure and 19.2 psia evaporator pressure (corresponding to 130° F. condenser temperature and −10° F. evaporator temperature, i.e. "Standard Conditions") then the work of compression and the refrigeration effect, in terms of enthalpies, will be $$W_c=h_2-h_1=94.1-76.2=17.9\ BTU/lb$$

$$Q_L=h_1-h_4=76.2-38.5=37.7\ BTU/lb$$

If by venting of outside air the condenser temperature is lowered from 130° F. to 110° F. the work of compression and the refrigeration effect will become $$W_c'=h_2'-h_1=92.1-76.2=15.9\ BTU/lb$$

$$Q_L'=h_1-h_4'=76.2-33.5=42.7\ BTU/lb$$

Thus by decreasing the condenser temperature by 20° F., the electrical energy required by the compressor has been reduced by $$(h_2-h_2')/(h_2-h_1)=(17.9-15.9)/17.9=0.11 \text{ or } 11\%$$

At the same time, the refrigeration effect has increased by $$(h_4-h_4')/(h_1-h_4)=(42.7-37.7)/37.7=0.13 \text{ or } 13\%$$

The Coefficient of Performance of the refrigerator increased from $$COP=(h_1-h_4)/(h_2-h_1)=37.7/17.9=2.11$$

to $$COP=(h_1-h_4')/(h_2'-h_1)=42.7/15.9=2.68$$

an improvement of 27%

In other words, assuming that the outside air temperature is low enough so that the temperature of the condenser can be reduced from 130F (54.4C) to 110F (43.3C), not only will the energy consumption of the refrigerator be significantly reduced, but its refrigeration capacity will be greatly increased, and its efficiency (COP) dramatically improved.

Thus, in accordance with the present invention, the fan 34 or 35 may be actuated when the outside air temperature drops to a predetermined threshold level (e.g. 80° F., 26.7° C.). Alternatively, it should be appreciated that the refrigerator 10 may already include a fan which may be used to divert some air flow into the compartment 24 from the outside. The energy transfer system 12 may also include a thermostatically actuated valve 38, such as the valve which would enable ambient air from inside the household to enter the compartment 24 when the outside air temperature is above a particular threshold level (e.g. 80° F., 26.7° C.). In this way, the compartment 24 will always be provided with a sufficient supply of air flow to cool the condenser 16.

Figure 5:
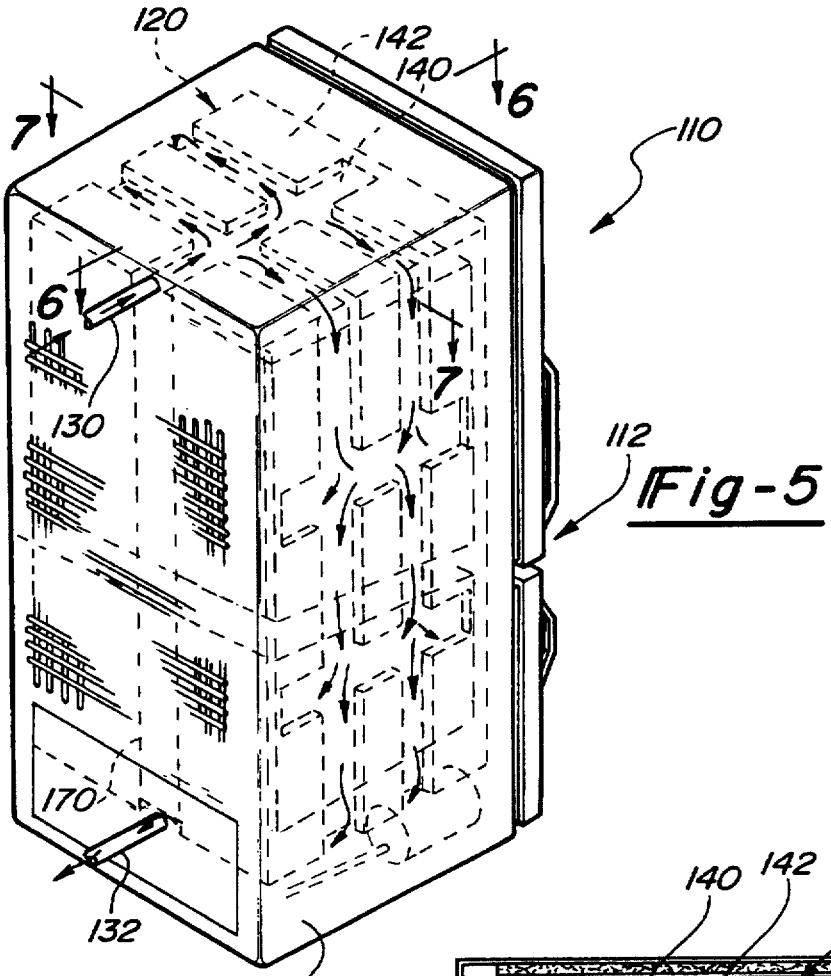
FIG. 5 is a perspective view of a refrigeration appliance in accordance with the present invention.

Turning to FIGS. 5 through 8, additional embodiments of the present invention will be described. FIG. 5 illustrates a refrigerator 110 having a split door 112 and a housing 114. The housing 114 surrounds the refrigeration compartment 116 which includes freezer 122 and cold storage 124 compartments. Also illustrated in phantom is a venting system 120.

Figure 6:
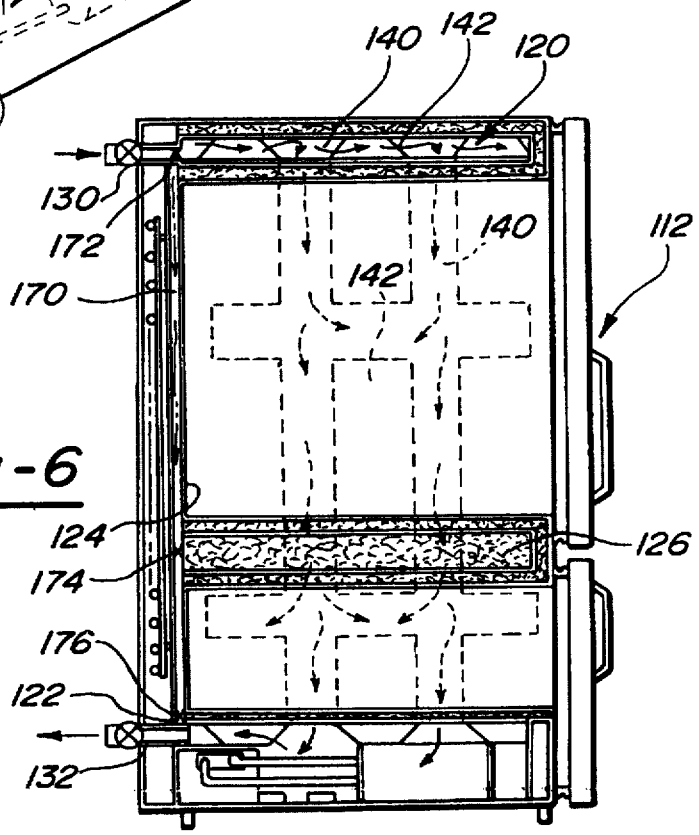
FIG. 6 is a cross-sectional view of FIG. 5 along line 6—6 thereof.

As seen in FIGS. 6 and 7, the freezer 122 and cold storage 124 compartments are surrounded by insulation 126 to maintain a predetermined cold temperature in the compartments. The venting system 120, as illustrated in FIGS. 5 through 7, may surround the compartments 122, 124 or it may be strategically positioned at the top, sides, or bottom of the refrigerator housing. The venting system 120 may take various forms, however, it may be as simple as a gap between the insulation and housing enabling circulation of cold air from the inlet 130 around the compartments within the housing and exiting outlet 132. Various types of spacers or the like may be utilized to form the gap between the insulation and housing.

As illustrated, cold air enters the inlet 130, and is diffused throughout the top of the refrigerator. The air moves along the sides around the storage 122 and freezer 124 compartments. The cool air then moves around the compressor area 136 and the bottom of the compartments and exits out of the refrigerator. Various types of films or the like may be utilized to cut down on dust and condensation, if present, between the housing and the insulation. As the air circulates within the refrigerator housing 114 and is directed toward the inlet, the hot air generated around the compressor is also collected and exited from the refrigerator. Thus, by providing cool air circulating around the storage and freezer compartments, it requires less work from the compressor, since the hot air surrounding the compartments has been removed. Thus, this increases the efficiency and decreases the amount of work performed by the compressor which, in turn, reduces the overall electric consumption of the refrigerator.

In FIGS. 5 through 7, the air flow is shown entering the refrigerator housing through the inlet 130. As the air enters the inlet 130, it is deflected by a number of channels 140 separated by vanes 142. As the air deflects around the vanes into the channels, it is directed along the sides of the refrigerator, as seen in FIGS. 5 through 7. Upon flow along the sides of the compartment, the air is directed towards the compressor area 160. The air circulates around the compressor area 160. The air circulates around the compressor 162 and then exits through the outlet 132. A number of different vane and channel designs may be utilized to move the air throughout the refrigerator. Thus, the specific numbers of vanes and channels for movement of the air may be modified as desired to optimize the cooling of the area. Also, an additional conduit 170 and valving may be coupled with the inlet 130. The conduit 170 includes valves 172, 174, 176 which open and close to direct air flow into the refrigerator housing. In cases where the ambient temperature is above a desired temperature where it will not cool the storage compartments but cool the compression area, the valves 172, 174, 176 can be adjusted to direct the air flow directly into the desired area.

Preferably, the compressor cooling fan would be utilized to draw the air into the housing. However, an additional fan may be used.

Also, as mentioned above, a thermostatically actuated valve, fan or the like may be positioned into the conduits for enabling passage of air. Also, conduits would be adaptable to receive air from the ambient surroundings of the refrigerator.

FIG. 8 illustrates yet another embodiment of the present invention. In FIG. 8, the freezer 180 and cold storage 182 compartments are surrounded by a number of channels 184, 186, respectively, which are in communication with first and second inlets 188,190 which are connected with the outside environment. Inlets 188, 190 are also each provided with a valve 192 which is openable to allow air from within the house or building to be mixed with the outside air passing through inlets 188, 190. Channels 184, 186 are also each connected to an outlet 194, 196, which is preferrably located near the bottom of the freezer 180 and cold storage 182 compartments. Outside air is drawn through inlets 188, 190 by a fan or blower (not shown) and passes through channels 184, 186 in order to cool freezer 180 and cold storage 182 compartments.

The compressor area 198 of the refrigerator 200 is provided below freezer compartment 180. A third inlet 202 is provided in the compressor area 198 for allowing outside air to circulate within the compressor area to cool the compressor or other components of the refrigerator system. Third inlet 202 is provided with a valve 204 which allows air from within the house to mix with the outside air. Mixing of inside air with outside air is desirable because some of the refrigerator components cannot be allowed to become to cold. Thus, when the temperature of the outside air is detected as being below a predetermined threshold temperature, valve 204 is opened to provide internal air which is mixed with the cold outside air. A third outlet 206 is also provided for allowing the air in the compressor area to be exhausted after cooling the compressor area 136. The outlets 194, 196, 206 are also provided with a valve 208 for releasing the exhaust air within the house as a means of providing fresh air within the house. The cold outside air is warmed as it passes through the refrigerator 200 and is released inside the house. Thus, the fresh air is efficiently warmed by the refrigerator 200 before being released into the house. Modern day houses are well insulated and sealed nearly airtight in order to keep out drafts and reduce heating costs. In such a well insulated home, circulation of fresh air within the home is sacrificed for heating efficiency unless some other means of introducing fresh air is introduced. The system of FIG. 8 provides an economical method for introducing fresh air into the home since the outside air is warmed by the heat generated by the refrigerator 200. Valves 208 may be opened manually when fresh air is desired within the household or can be controlled electronically to open periodically so that fresh air is introduced into the house on a regular basis.

The present invention has been described in an illustrative manner. In this regard, it is evidence that those skilled in the art once given the benefit of the foregoing disclosure, may now make modifications to the specific embodiments described herein without departing from the spirit of the present invention. Such modifications are to be considered within the scope of the present invention which is limited solely by the scope and spirit of the appended claims.

What is claimed is:

1. A refrigeration or freezer appliance comprising:

a housing surrounding a cooling storage compartment;

refrigeration means for cooling said cooling storage compartment, said refrigeration means having components including a compressor and a condenser;

at least one passage disposed adjacent to said cooling storage compartment and having a first inlet and a first outlet for enabling ingress and egress of outdoor outside air and a venting system positioned within said housing for circulating the outdoor outside air through and out of said housing;

a compartment for storing at least one of said components of said refrigeration means fluidly isolated from said passage and having a second inlet and a second outlet for enabling ingress and egress of outdoor outside air and a venting system positioned within said compartment for circulating the outdoor outside air through and out of said compartment.

2. The refrigeration appliance according to claim 1, wherein said first and second inlets are connected with conduits which deliver outside air through said first and second inlets.

3. The refrigeration appliance according to claim 1, wherein said first and second inlets are provided with a valve for allowing inside air to be mixed with outside air.

4. The refrigeration appliance according to claim 1, further comprising a second cooling storage compartment within said housing.

5. The refrigeration appliance according to claim 4, further comprising a third inlet and a third outlet communicating with a passage around said second cooling storage compartment.

6. The refrigeration appliance according to claim 5, wherein said third inlet is provided with a valve for allowing inside air to be mixed with outside air.

* * * * *

UNITED STATES PATENT AND TRADEMARK OFFICE

CERTIFICATE OF CORRECTION

PATENT NO. : 5,743,109

DATED : April 28, 1998

INVENTOR(S) : Edward R. Schulak

It is certified that error appears in the above-identified patent and that said Letters Patent is hereby corrected as shown below:

Column 1 of the cover page, please add:

Related U.S. Application Data

[63] Continuation-in-part of Ser. No. 08/648,197 filed May 23, 1996, Patent No. 5,775,113, which is a continuation of Ser. No. 08/167,741 filed December 15, 1993, Patent No. 5,402,651.

Column 4, line 51, please delete "130F" and substitute therefor --130°F--

Column 4, line 51, please delete "(54.4C)" and substitute therefor --(54.4°C)--

Column 4, line 51, please delete "110F" and substitute therefor --110°F--

Column 4, line 51, please delete "(43.3C)" and substitute therefor --(43.3°C)--

Column 6, line 24, please delete "to" and substitute therefor --too--.

Signed and Sealed this

Third Day of October, 2000

*Attest:*

*Attesting Officer*

Q. TODD DICKINSON

*Director of Patents and Trademarks*